US007947929B2

(12) United States Patent
Oh et al.

(10) Patent No.: US 7,947,929 B2
(45) Date of Patent: May 24, 2011

(54) CONTROL APPARATUS FOR DRYER

(75) Inventors: Chang Hun Oh, Changwon-si (KR); Seon Il Heo, Changwon-si (KR); Yang Hwan Kim, Changwon-si (KR); Yeong Sik Choi, Changwon-si (KR); Seog Ho Ko, Changwon-si (KR); Ju Han Yoon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 434 days.

(21) Appl. No.: 12/104,754

(22) Filed: Apr. 17, 2008

(65) Prior Publication Data

US 2009/0139110 A1 Jun. 4, 2009

(30) Foreign Application Priority Data

Apr. 18, 2007 (KR) ..... 10-2007-0038078

(51) Int. Cl.
*H05B 1/02* (2006.01)

(52) U.S. Cl. ..... 219/482; 219/494; 219/508; 219/481; 34/543; 34/553

(58) Field of Classification Search ..... 219/494, 219/497, 507, 508, 501, 481, 482; 34/269, 34/492, 543, 553
See application file for complete search history.

(56) References Cited

U.S. PATENT DOCUMENTS

| | | | | |
|---|---|---|---|---|
| 3,854,034 | A * | 12/1974 | Leitner et al. | 219/494 |
| 4,167,663 | A * | 9/1979 | Granzow et al. | 219/497 |
| 4,302,663 | A * | 11/1981 | Chesnut et al. | 219/497 |

FOREIGN PATENT DOCUMENTS

| | | |
|---|---|---|
| DE | 10 2007 042 060 | 3/2008 |
| DE | 10 2007 062 070 | 7/2008 |
| GB | 2236334 | 4/1991 |
| JP | 2005-152406 | 6/2005 |
| JP | 2005-342298 | 12/2005 |
| KR | 10-1995-0023775 | 8/1995 |
| KR | 10-2004-0096144 | 11/2004 |
| KR | 10-2006-0058496 | 5/2006 |
| KR | 10-2006-0083424 | 7/2006 |

OTHER PUBLICATIONS

Korean Application No. 10-2007-0038078 Notice of Allowance dated Sep. 5, 2008.

Australian Application No. 2008201736 Notice of Allowance dated Feb. 4, 2010.

German Office Action dated Jan. 18, 2011 (10 2008 09 549.9-26).

* cited by examiner

*Primary Examiner* — Mark H Paschall
(74) *Attorney, Agent, or Firm* — Ked & Associates LLP

(57) ABSTRACT

A control apparatus for a dryer is provided. The control apparatus provides a connection for a detecting circuit adapted to determine a clogging degree of the dryer. The control apparatus includes a power supply circuit including a heating coil arranged in a heater case, a temperature control member mounted to the heater case, the temperature control member being configured to receive power and supply the received power to the heating coil, a microcomputer that controls an operation of the dryer, and a connecting line that connects the power supply circuit to the microcomputer. The microcomputer can detect a state of the power supply circuit through the connecting line.

9 Claims, 7 Drawing Sheets

[FIG1]
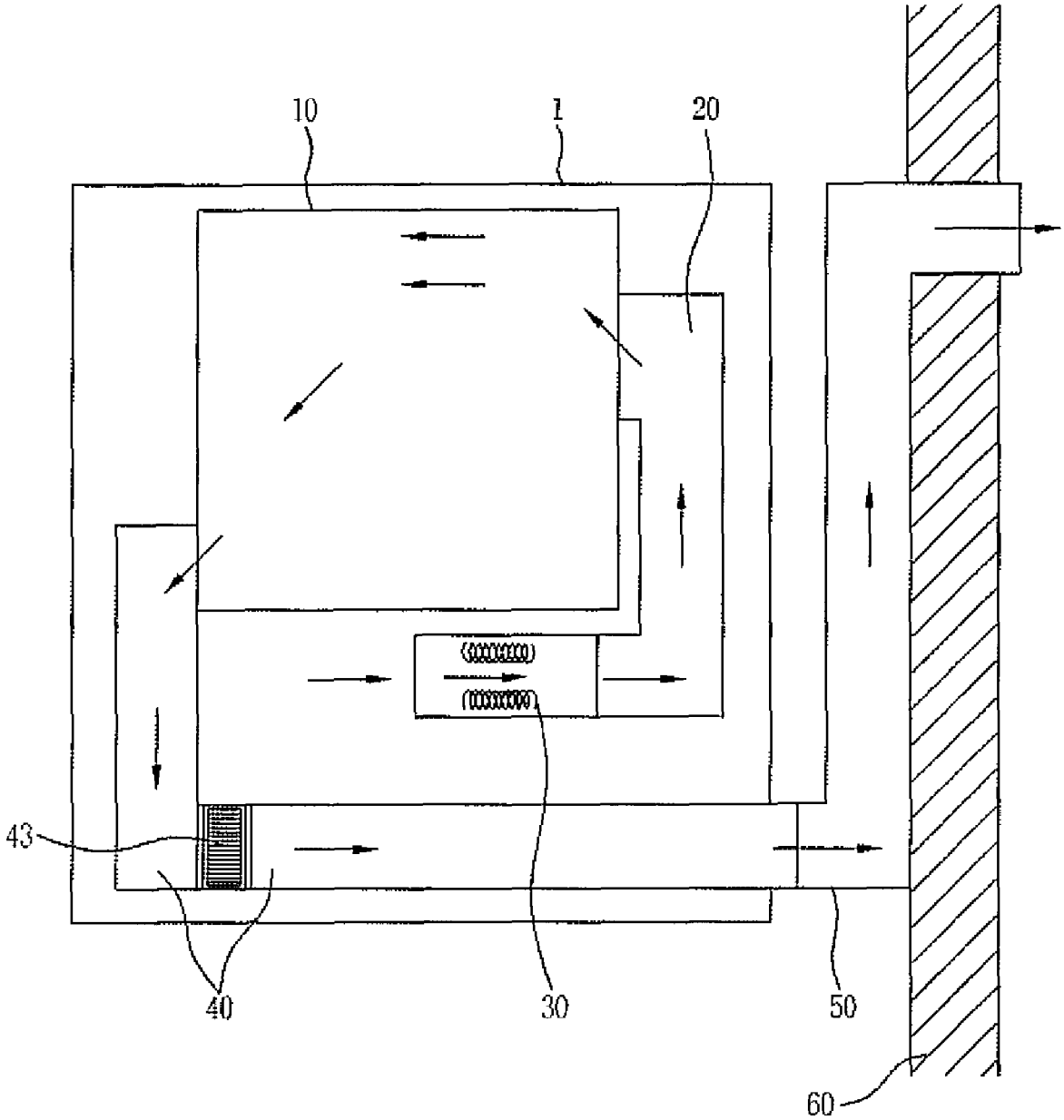

[FIG2]
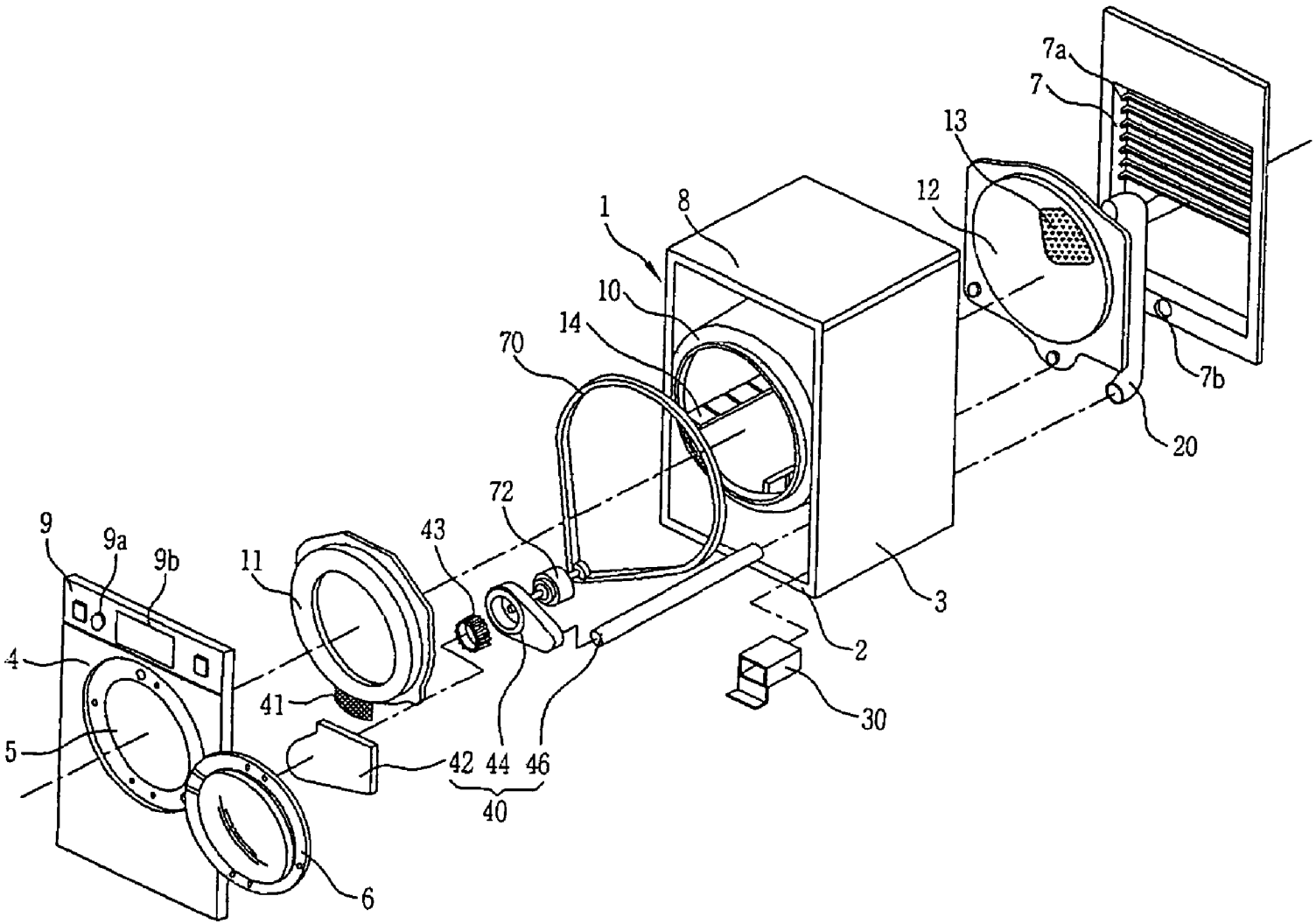

[FIG3]
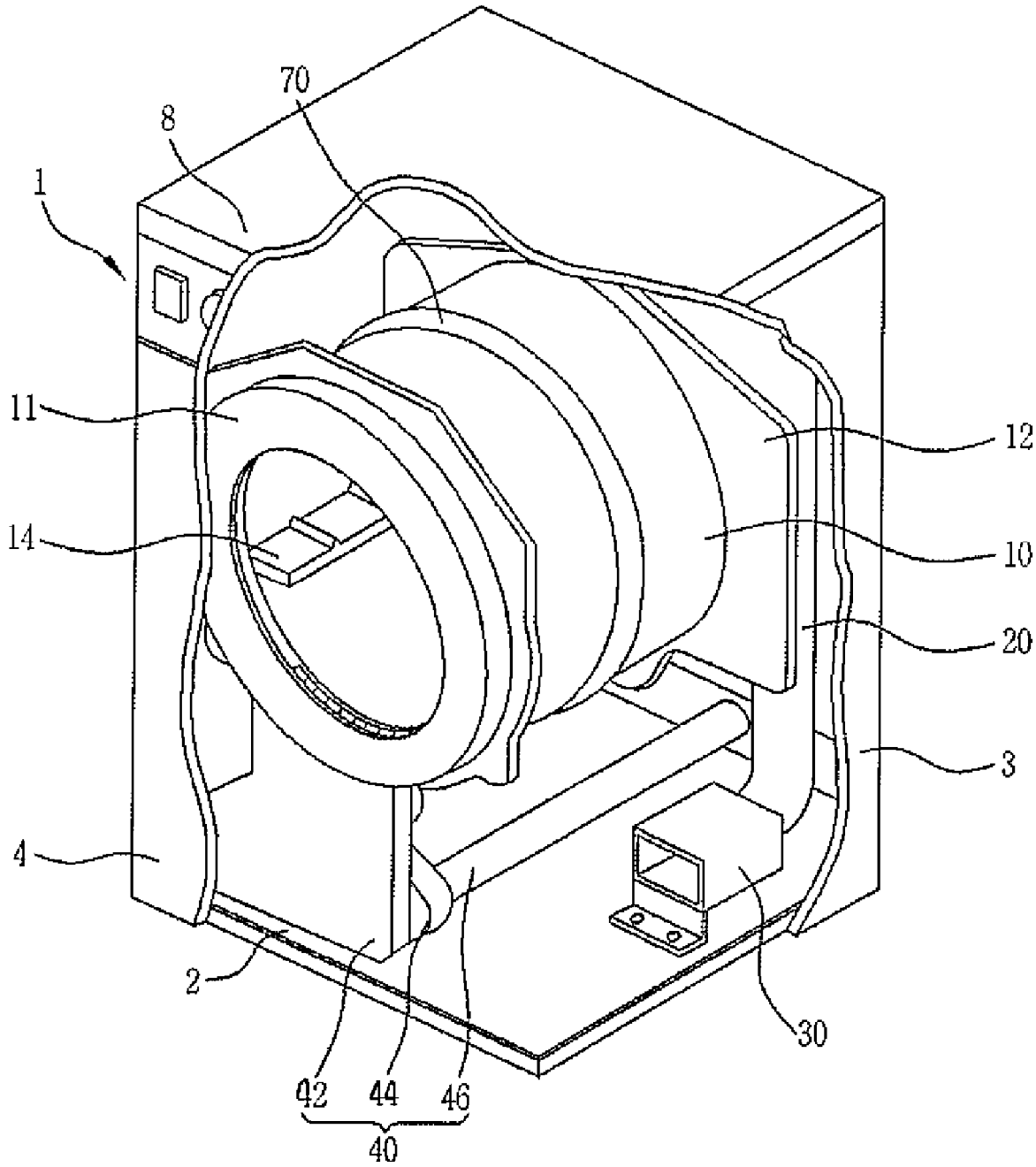

[FIG4]
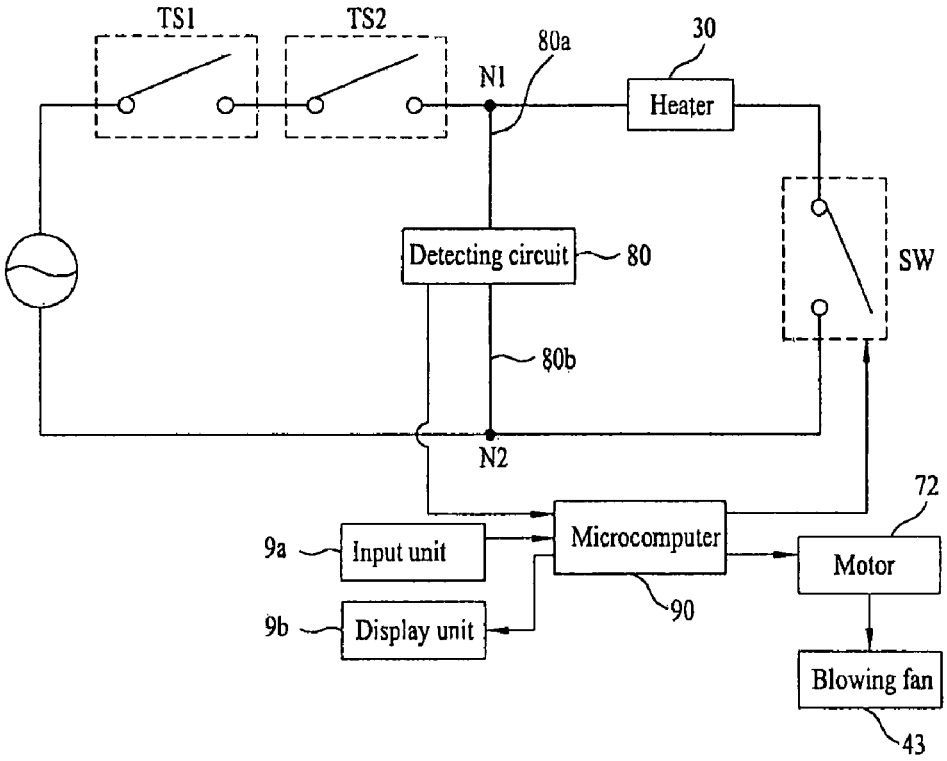
[FIG5]
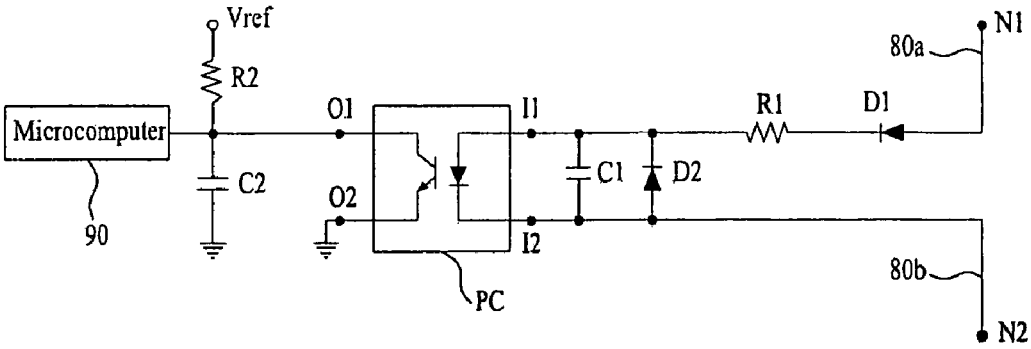

[FIG6A]
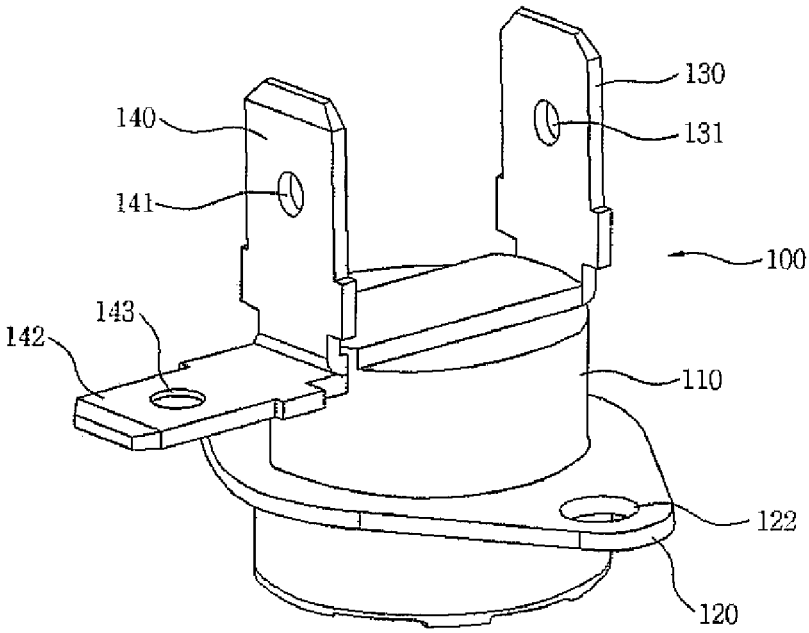
[FIG6B]
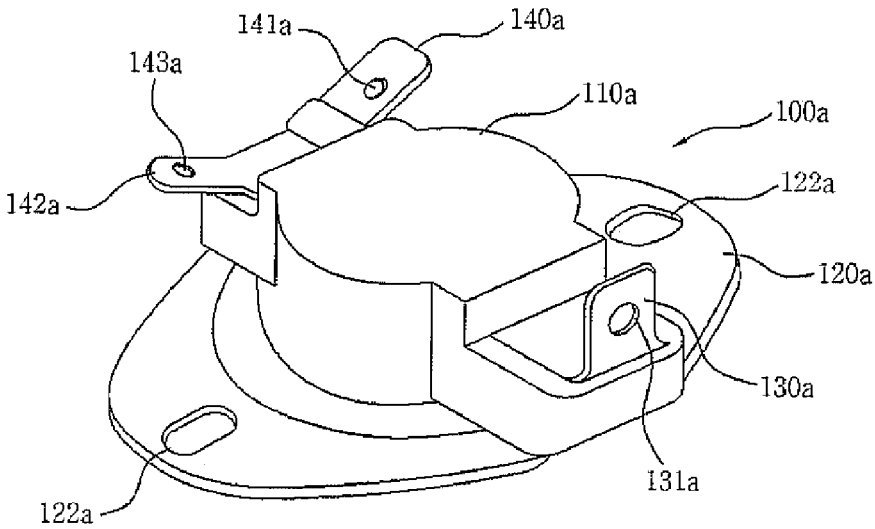

[FIG7]
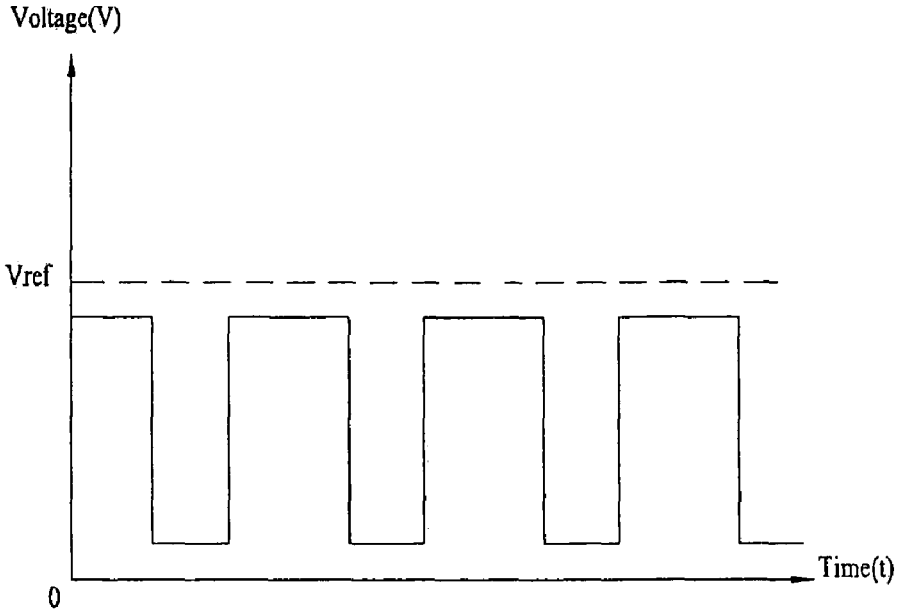
[FIG8]
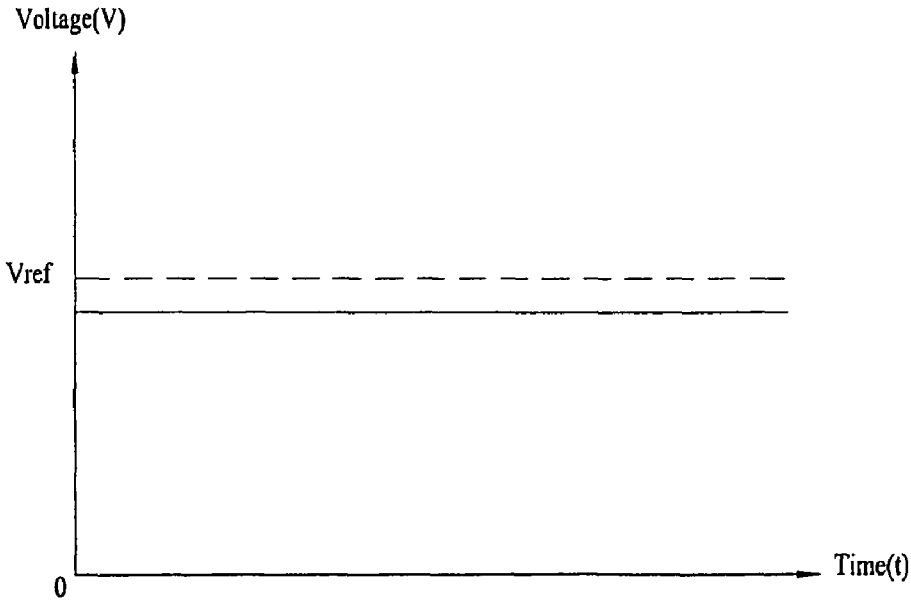

[FIG9]
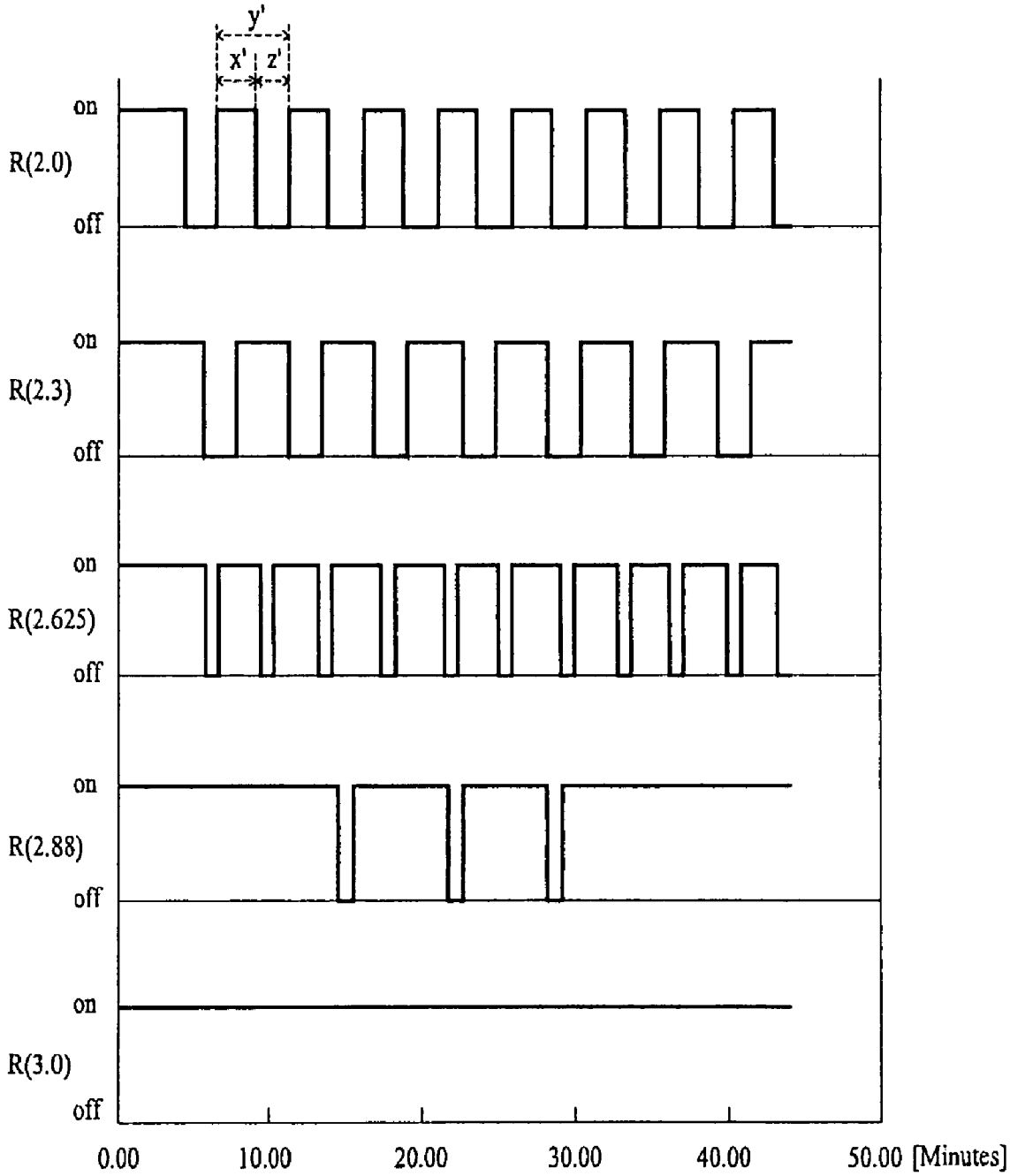

CONTROL APPARATUS FOR DRYER

This application claims the benefit of Korean Patent Application No. 10-2007-0038078, filed on Apr. 18, 2007, which is hereby incorporated by reference as if fully set forth herein.

BACKGROUND OF THE INVENTION

1. Field of the Invention

The present invention relates to a dryer, and more particularly to a control apparatus for a dryer, which can provide a connection for a detecting circuit adapted to determine a clogging degree of the dryer.

2. Discussion of the Related Art

Generally, a washing machine includes a body having a certain shape, a drum installed in the body, and a tub arranged to surround the drum. Wash water is collected in the tub. The washing machine also includes a drive motor for rotating the drum, a detergent box for supplying a detergent, a water supply pipe connected to the detergent box, to supply wash water alone or in a state of being mixed with the detergent supplied from the detergent box, and a drainage pipe for outwardly draining wash water used in a washing cycle. The washing machine further includes a pump and drainage hose, which are connected to an outer end of the drainage pipe, to forcibly drain the wash water.

The above-mentioned washing machine performs a washing operation using friction generated between laundry and wash water in the drum when the laundry falls by gravity during rotation of the drum. Recently, drum washing machines with various additional functions have been developed. For example, a drum washing machine, which has a drying function, not only to wash laundry, but also to dry laundry using hot air, has been developed.

Washing machines, which have a drying function as described above, are classified into a condensation type and an exhaustion type. In a condensation type washing machine, hot air generated from a heater is supplied to a drum by a blowing fan, to dry laundry contained in the drum. In this case, the air used to dry the laundry in the drum is in a hot and high-humid state. The air then flows to an air outlet communicating with a tub. At one side of the air outlet, a nozzle is arranged to inject cold water. By the nozzle, moisture is removed from the hot and high-humid air, to generate dry air, which is, in turn, supplied to the blowing fan.

In an exhaustion type washing machine, hot air generated from a heater and blown by a blowing fan flows to pass through laundry contained in a drum. The hot air is then exhausted to the outside of the washing machine through an exhaust port formed at one side of the washing machine. The exhaust port is connected to a bellows tube connected to a tub. The exhaust port also functions as a breath port when a baby or pet is confined in the washing machine.

In the washing machine, which has the above-mentioned exhaustion type drying function, lint may be produced from laundry during a drying operation. The lint is discharged to the outside of the washing machine through the exhaust port after circulating through the drum along with the hot air.

In order to prevent lint produced from laundry from being accumulated in the exhaust port, which functions to discharge lint to the outside of the washing machine, a structure capable of periodically collecting and removing lint is provided. For example, a lint filter is mounted in the exhaust port, in order to prevent the exhaust port from being clogged by lint when the washing machine is used for a prolonged period of time.

For the simplicity of description, the above mentioned drying machines, which have a drying function, will be simply referred to as "dryers".

Such a conventional dryer recommends for the user to clean the filter whenever the dryer is used. However, the user may frequently neglect the filter cleaning due to inconvenience and troublesome caused by the cleaning. In this case, the clogging degree of the filter increases as the drying operation is repeated. For this reason, an increase in drying time and an increase in power consumption may occur. When the clogging degree is excessive, lint may float in the drum without being collected by the filter, and may then be attached to the laundry and the inner surface of the dryer. In this case, the laundry may be contaminated by the lint. Furthermore, in the exhaustion type dryer, lint may be accumulated in the exhaust port functioning to exhaust air, which has been used to dry laundry, to the outside of the dryer, so that the lint may interfere with a flow of air. In this case, it is very difficult for the user to recognize such clogging of the exhaust port.

SUMMARY OF THE INVENTION

Accordingly, the present invention is directed to a control apparatus for a dryer that substantially obviates one or more problems due to limitations and disadvantages of the related art.

An object of the present invention is to provide a control apparatus for a dryer, which provides a connection between a temperature control member and a microcomputer (or a detecting circuit), to determine the clogging degree of an air passage defined in the dryer.

Another object of the present invention is to provide a control apparatus for a dryer, which is capable of achieving an easy identification of input and output terminals in an operation to connect a temperature control member and a microcomputer (or a detecting circuit) in an assembly operation for the dryer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control apparatus for a dryer comprising: a power supply circuit comprising a heating coil arranged in a heater case, and at least one temperature control member mounted to the heater case, the temperature control member receiving power, and supplying the received power to the heating coil; a microcomputer for controlling an operation of the dryer; and a connecting line for connecting the power supply circuit to the microcomputer.

The temperature control member may be mounted to an outer surface of the heater case.

The control apparatus may further comprise a detecting circuit connected to the connecting line, to detect an ON/OFF state of the temperature control member.

The connecting line may be connected to an electric wire between the temperature control member and the heating coil.

The temperature control member may comprise an input terminal connected to a power source, a first output terminal connected to the heating coil, and a second output terminal connected to the connecting line.

The first and second output terminals may have at least portions connected to each other, respectively.

The first and second output terminals may be integrated with each other.

The at least one temperature control member may comprise a non-return type temperature control member, which is transited from an ON state to an OFF state in a non-returning manner in accordance with ambient temperature, and a return type temperature control member, which is transited between an ON state and an OFF state in a returnable manner in accordance with ambient temperature.

The connecting line may be connected to an output terminal of the non-return type temperature control member, or to an output terminal of the return type temperature control member.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a sectional view of a dryer according to the present invention;

FIG. 2 is an exploded perspective view of the dryer according to the present invention;

FIG. 3 is a partially-broken perspective view of the dryer according to the present invention;

FIG. 4 is a circuit configuration of a display device used in the dryer in accordance with the present invention;

FIG. 5 is a circuit diagram illustrating an exemplary embodiment of a detecting circuit shown in FIG. 4;

FIGS. 6A and 6B are perspective views illustrating embodiments of a temperature control member for a connection of the detecting circuit, respectively;

FIGS. 7 and 8 are waveform diagrams of outputs from the detecting circuit; and FIG. 9 is a waveform diagram depicting waveforms of detect signals recognized by a microcomputer.

DETAILED DESCRIPTION OF THE INVENTION

Reference will now be made in detail to the preferred embodiments of the present invention associated with, for example, a dryer, examples of which are illustrated in the accompanying drawings. However, the scope of the present invention is not limited to the following embodiments and drawings. The scope of the present invention is limited only to the contents defined in the claims, which will be described later.

FIG. 1 is a sectional view of a dryer according to the present invention. FIG. 2 is an exploded perspective view of the dryer according to the present invention. FIG. 3 is a partially-broken perspective view of the dryer according to the present invention. The following description will be given in conjunction with an embodiment in which the present invention is applied to an exhaustion type dryer. However, the present invention is not limited to the exhaustion type dryer.

As shown in FIG. 1, the exhaustion type dryer according to the illustrated embodiment includes a cabinet 1, a drum 10 arranged in the cabinet 1, to contain laundry, a suction passage 20 formed to suck air into the drum 10, a heater 30 arranged in the suction passage 20, and an exhaust passage 40 formed to exhaust the air emerging from the drum 10 to the outside of the cabinet 1. In the case of this exhaustion type dryer, an external exhaust duct 50, which extends through an inner wall 60 of a building, is connected to the exhaust passage 40, to outwardly exhaust the air.

A blowing fan 43 is arranged in one of the suction passage 20 and exhaust passage 40. The following description will be given only in conjunction with the case in which the blowing fan 43 is arranged in the exhaust passage 40.

As shown in FIGS. 2 and 3, the cabinet 1 includes a base panel 2, a cabinet body 3 installed on the base panel 2, a cabinet cover 4 mounted to a front side of the cabinet body 3, a back panel 7 mounted to a back side of the cabinet body 3, and a top cover 8 mounted to a top side of the cabinet body 3. The cabinet 1 also includes a control panel 9 mounted to an upper end portion of the cabinet cover 4.

As shown in FIG. 2, a laundry loading/unloading hole 5 is formed through the cabinet cover 4. A door 6 is pivotally connected to the cabinet cover 4, in order to open or close the laundry loading/unloading hole 5. The control panel 9, which is mounted to the upper end portion of the cabinet cover 4, includes an input unit 9*a* for acquiring an input from the user, and a display unit 9*b* for displaying a state of the dryer (including, for example, a drying operation progress, a drying degree, a residual drying time, a selected drying mode, etc.). A front supporter 11 is mounted to a rear surface of the cabinet cover 4, to rotatably support a front end of the drum 10.

A rear supporter 12 is mounted to a front surface of the back panel 7, to rotatably support a rear end of the drum 10. A communicating hole 13 is formed through the rear supporter 12, to communicate the suction passage 20 with an inlet of the drum 10, and thus enabling air emerging from the suction passage 20 to be introduced into the inlet of the drum 10.

As shown in FIGS. 2 and 3, the drum 10 has a cylindrical barrel structure forwardly and rearwardly opened to allow air to flow in forward and rearward directions while having a space to contain laundry. The drum 10 has a rear opening forming the inlet of the drum 10, and a front opening forming the outlet of the drum 10. In the drum 10, a lift 14 is mounted to an inner peripheral surface of the drum 10 such that the lift 14 is inwardly protruded, to raise laundry and then to allow the raised laundry to fall during rotation of the drum 10.

The suction passage 20 is defined by a suction duct having a lower end communicating with a rear end of the heater 30, and an upper end communicating with the communicating hole 13 of the rear supporter 12.

As shown in FIGS. 2 and 3, the heater 30 includes a heater case mounted on an upper surface of the base panel 2 while communicating with the suction passage 20, namely, the suction duct, and a heating coil arranged in the heater case. When electric power is supplied to the heating coil, the heater case and the interior of the heater case are heated. As a result, air passing through the interior of the heater case is heated, so that it becomes hot air having low humidity.

As shown in FIGS. 2 and 3, the exhaust passage 40 is defined by a lint duct 42, a fan housing 44, and an exhaust pipe 46. The lint duct 42 is arranged to communicate with the outlet of the drum 10, in order to allow air from the drum 10 to be exhausted. A lint filter 41 is arranged in the lint duct 42, to filter out foreign matter, such as lint, from the exhausted air. The fan housing 44 communicates with the lint duct 42. The blowing fan 43 is arranged in the fan housing 44. The exhaust pipe 46 has one end communicating with the fan housing 44, and the other end extending outwardly through the cabinet 1.

The external exhaust duct 50 is connected to the exhaust pipe 46, to guide the air outwardly exhausted from the cabinet 1 to the outdoors. The external exhaust duct 50 is formed at the outside of the cabinet 1, in order to guide air to the outdoors. The external exhaust duct 50 may extend through the building inner wall 60.

An air passage used in the present invention includes the suction passage 20, the inner space of the drum 10, the exhaust passage 40, and the external exhaust duct 50. Clogging of the air passage occurs mainly at the lint filter 41 of the exhaust passage 40 and in the external exhaust duct 50. The influence of the air flow interference caused by the clogging of the lint filter 40 in the exhaust passage 40 is relatively small, as compared to the influence of the air flow interference caused by the clogging of the external exhaust duct 50.

Hereinafter, operation of the exhaustion type dryer according to the illustrated embodiment of the present invention will be described.

The user closes the door 6 after loading laundry into the drum 10, and then operates the control panel 9, in order to operate the exhaustion type dryer. In accordance with the operation of the exhaustion type dryer, the heater 30 is turned on, and the motor 72 is driven.

When the heater 30 is in an ON state, it heats the interior thereof. As the motor 72 is driven, the blowing fan 43 and a belt 70 are rotated. In accordance with the rotation of the belt 70, the drum 10 is rotated. As a result, the laundry loaded in the drum 10 repeats operations of being raised by the lift 14, and then dropped.

During the rotation of the blowing fan 43, ambient air around the cabinet 1 is sucked into an air suction hole 7*a* formed through the back cover 7 by a blowing force generated in accordance with the rotation of the blowing fan 43. The sucked air is then guided between the cabinet 1 and the drum 10. The air introduced between the cabinet 1 and the drum 10 is introduced into the heater 30 which, in turn, heats the introduced air. As the air is heated, it comes into a state of high temperature and low humidity. Subsequently, the heated air is introduced into the drum 10 via the suction passage 20 and the communicating hole 13 of the rear supporter 12.

The hot and low-humid air introduced into the drum 10 comes into contact with the laundry as it flows forwardly in the drum 10, so that it comes into a high humid state. Thereafter, the air is introduced into the exhaust passage 40.

The air introduced into the exhaust passage 40 is guided by the exhaust pipe 46 such that it is outwardly exhausted through the external exhaust duct 50.

FIG. 4 is a circuit configuration of a control apparatus for the dryer in accordance with the present invention. The control apparatus shown in FIG. 4 includes first and second thermostats TS1 and TS2, each of which receives external commercial power, and supplies the received commercial power to the heater 30. Each of the first and second thermostats TS1 and TS2 is turned on/off in accordance with the temperature of the heater 30 or the temperature of air heated by the heater 30. In the following description, the first and second thermostats may also be simply referred to as "temperature control members". The control apparatus also includes a switch SW turned on/off in accordance with a control command from a microcomputer 90, to selectively apply the commercial power to the heater 30. The input unit 9*a* and display unit 9*b* are also included in the display device. The control apparatus further includes a detecting circuit 80 for detecting whether or not power is supplied to the heater 30, in accordance with the ON/OFF states of the first and second thermostats TS1 and TS2. The microcomputer 90, which is also included in the display device, determines whether or not the first and second thermostats TS1 and TS2 are in an ON state, based on the power supply ON/OFF state detected by the detecting circuit 80. Although not shown, a power supply is also provided to supply DC power converted from the commercial power to the microcomputer 90, input unit 9*a*, and display unit 9*b*. The power supply is well known by those skilled in the technical field to which the present invention pertains.

The first and second thermostats TS1 and TS2 function as controllers operating in accordance with temperature. The first and second thermostats TS1 and TS2 are mounted at one side of the heater 30 or in the vicinity of the heater 30. The first and second thermostats TS1 and TS2 respond to the temperature of the heater 30 or the temperature of air heated by the heater 30. Each of the first and second thermostats TS1 and TS2 is maintained in an ON state until it senses a predetermined overheating temperature. When the first or second thermostat TS1 or TS2 senses a temperature exceeding the predetermined overheating temperature, it is transited to an OFF state, thereby cutting off the supply of the commercial power to the heater 30. In particular, once the first thermostat TS1 is transited to an OFF state, it does not return to an ON state (non-return type temperature control member), in order to assist the second thermostat TS2 (return type temperature control member). The first and second thermostats TS1 and TS2 are mounted to, for example, the suction passage 20 connected to the heater 30.

The switch SW is constituted by an element such as a relay. The switch SW is maintained in an ON state during a drying operation in accordance with an ON-control operation of the microcomputer 90, while being maintained in an OFF state in accordance with an OFF-control operation of the microcomputer 90.

The input unit 9*a* receives control commands input from the user in association with the drying operation, and applies the control commands to the microcomputer 90.

The display unit 9*b* displays the control commands input from the user in association with the drying operation, the drying operation progress, the residual drying time, the clogging degree of the air passage, the clogged position, etc. In the present invention, the air passage includes the suction passage 20, the inner space of the drum 10, the exhaust passage 40, and the external exhaust duct 50. In particular, the air passage may designate the lint filter 41 of the exhaust passage 40 and the external exhaust duct 50.

The detecting circuit 80 is connected to nodes N1 and N2, to detect whether or not current flows through a DC circuit including the heater 30, namely, whether or not power is supplied to the heater 30. For this determination, the detecting circuit 80 is connected to the nodes N1 and N2 by connecting lines 80*a* and 80*b*, respectively. The detecting circuit 80 is mounted on the control panel 9, on which the microcomputer 90 is also mounted. Accordingly, the connecting lines 80*a* and 80*b* extend along the inner space between the drum 10 and the cabinet body 3 or along the inner surface of the cabinet body 3.

In detail, the detecting circuit 80 detects whether or not power is supplied to the heater 30 in accordance with ON/OFF operations of the first and second thermostats TS1 and TS2 responding to the temperature of the heater 30 or the temperature of air heated by the heater 30. Of course, the supply of power to the heater 30 is also controlled by the switch SW. However, the switch SW operates under the control of the microcomputer 90. Accordingly, the microcomputer 90 determines whether or not power is supplied to the heater 30, based on a detect signal from the detecting circuit 80, in an ON state of the switch SW. When the switch SW is in an OFF state under the control of the microcomputer 90, the microcomputer does not take into consideration the detect signal from the detecting circuit 80.

The detecting circuit 80 sends a detect signal corresponding to a power supply or cutoff state to the microcomputer 90, so as to enable the microcomputer 90 to identify the power supply or cutoff state, based on the detect signal. Different from the circuit configuration shown in FIG. 4, the detecting circuit 80 may have input terminals respectively connected between the first thermostat TS1 and a commercial power source and between the heater 30 and the switch SW. In the case of a DC circuit including the first and second thermostats TS1 and TS2, heater 30, and switch SW, it is possible to most clearly identify the voltage difference generated across the heater 30 when commercial power is supplied. The DC circuit is referred to as a "power supply circuit". Accordingly, the connection of the detecting circuit 80 is achieved to always detect a voltage difference generated in a circuit including the heater 30.

As described above, the microcomputer 90 basically controls the heater 30, switch SW, and motor 72 in accordance with a command input from the user through the input unit 9*a*, and controls the blowing fan 43 in accordance with the control for the motor 72, for the execution of a desired drying operation. The microcomputer 90 is also equipped with a storage (not shown) to store a control algorithm for the above-described control operations. For the storage, for example, an EEPROM may be used.

The microcomputer 90 and detecting circuit 80 are mounted to a back surface of the above-described control panel 9.

The microcomputer 90 also determines information as to the power supply or cutoff carried out by the first and second thermostats TS1 and TS2 in accordance with the detect signal from the detecting circuit 80.

FIG. 5 illustrates an exemplary embodiment of the detecting circuit shown in FIG. 4. As shown in FIG. 5, the detecting circuit 80 includes a diode D1 for passing a positive (+) component of an input voltage from the node N1, a resistor R1 for reducing the input voltage from the node N1, and a photocoupler PC to turn on/off in accordance with the input voltage. The detecting circuit 80 also includes a diode D2 and a capacitor C1 to prevent noise components of the input voltage from being applied to input terminals I1 and I2 of a photocoupler PC. The detecting circuit 80 further includes a resistor R2 and a capacitor C2, which are connected to an output terminal O1 of the photocoupler PC, to provide, to the microcomputer 90, a DC voltage lower than a reference voltage Vref in accordance with an ON or OFF state of the photocoupler PC. The DC voltage has different waveforms respectively corresponding to the ON and OFF states of the photocoupler PC. The reference voltage Vref is used as a drive voltage for the microcomputer 90 in the circuit, which includes the microcomputer 90. Although no description will be given of a voltage source for generating the reference voltage Vref, this voltage source is well known by those skilled in the technical field to which the present invention pertains. The detecting circuit 80 may be integrated with the microcomputer 90 in the form of a single module. Alternatively, the detecting circuit 80 may be mounted on a printed circuit board in the form of a module. That is, the detecting circuit 80 may be built in the microcomputer 90.

Where the commercial power has a voltage of, for example, AC 240V, the voltage difference between the node N1 and the node N2. When this voltage is directly applied to the photocoupler PC, the photocoupler PC may be damaged. To this end, the resistor R1 is used to reduce the input voltage to a several ten V.

When there is a voltage difference between the node N1 and the node N2, namely, when the first and second thermostats TS1 and T52 turn on to enable power to be supplied to the heater 30, a voltage corresponding to the voltage difference is applied to the input terminals I1 and I2 of the photocoupler PC. Since the applied voltage is an AC voltage, a photodiode, which is included in the photocoupler PC, as a light emitter, periodically emits light in accordance with the cycle of the voltage. Accordingly, a transistor, which is also included in photocoupler PC, as a light receiver, is periodically turned on/off. As a result, a square wave is applied to the microcomputer 90. On the other hand, when there is no voltage difference between the node N1 and the node N2, namely, when the first and second thermostats TS1 and TS2 turn off to prevent power from being supplied to the heater 30, the input terminals I1 and I2 of the photocoupler PC are maintained at the same voltage level. The photodiode of the photocoupler PC does not emit light, so that the transistor of the photocoupler PC is maintained in an OFF state. As a result, a DC voltage waveform approximate to the reference voltage Vref is continuously applied to the microcomputer 90.

As a method for easily connecting the detecting circuit 80 and power supply circuit, there is a method in which the detecting circuit 80 is connected to electric wires or leads connecting the elements of the power supply circuit, using electric wires or leads (a kind of direct wire connecting method). That is, the connecting line 80*a* may be directly connected to the electric wire or lead connecting the first and second thermostats TS1 and TS2, or may be directly connected to the electric wire or lead connecting the second thermostat TS2 and heater 30. This direct connection may be achieved by removing a cladding from each electric wire or lead, and directly connecting the connecting line 80*a* to the electric wire or lead. The connecting line 80*b* is connected to an input terminal of the commercial power source, or to a downstream end of the switch SW.

FIGS. 6A and 6B are embodiments of a temperature control member for the connection of the detecting circuit. The above-described direct wire connecting method may have a problem in that the worker cannot easily perform the removal of the cladding in the manufacture of the dryer, and may erroneously connect the electric wire or lead to an incorrect position due to a confusion about the position of the node N1. Of course, the position of the node N1 can be easily identified because it corresponds to the input terminal of the commercial power source or the downstream end of the switch SW.

To this end, each temperature control member has a structure capable of reliably achieving the above-described connection, as shown in FIGS. 6A and 6B.

As shown in FIG. 6A, the temperature control member 100 includes a bracket 120 partially holding a temperature control element 110, to mount the temperature control element 110 to an outer surface of the heater case. The temperature control member 100 also includes an input terminal 130, and two output terminals 140 and 142.

The input terminal 130 is connected to the commercial power source. One of the output terminals 140 and 142, namely, the output terminal 140, is connected to the heating coil. The other output terminal, namely, the output terminal 142, is connected to one connecting line.

The bracket 120 is provided with two openings 122 so that it can be mounted to the outer surface of the heater case by fasteners such as screws. Also, the input terminal 130 and output terminals 140 and 142 are provided with openings 131, 141, and 143, respectively. Accordingly, the worker can easily connect the terminals 130, 140, and 142 to connecting lines by simply inserting the connecting lines into the openings 131, 141, and 143, respectively.

In particular, the output terminals 140 and 142 have portions connected to each other, respectively, as shown in FIG. 6A. Accordingly, the worker can easily distinguish the output terminals 140 and 142 from the input terminal 130.

The temperature control member 100*a* shown in FIG. 6B has a structure similar to that of FIG. 6A. That is, the temperature control member 100*a* includes a temperature control element 110*a*, a bracket 120*a*, an input terminal 130*a*, and two output terminals 140*a* and 142*a*. In this case, the two output terminals 140*a* and 142*a* have an integrated structure.

At least one of temperature control members, which have a structure shown in FIG. 6A or 6B, is applied to the first thermostat TS1 or second thermostat TS2 of FIG. 5. That is, the output terminals 140 and 142 or 140*a* and 142*a* of the applied temperature control member 100 or 100*a* correspond to the node N1 of FIG. 5.

FIGS. 7 and 8 are graphs depicting output waveforms of the detecting circuit, respectively. When the first and second thermostats TS1 and TS2 are in an ON state, the commercial power, which has an AC voltage, is applied to the heater 30. Accordingly, a voltage difference corresponding to the AC voltage of the commercial power is generated between the node N1 and the node N2. In accordance with this voltage difference, the photocoupler PC is turned on. Due to the AC voltage, however, the photocoupler PC is repeatedly turned on and off in accordance with the cycle of the commercial power. As a result, a square wave lower than the reference voltage Vref is applied to the microcomputer 90, as shown in FIG. 7.

On the other hand, when the first and second thermostats TS1 and TS2 are in an OFF state, no power is supplied to the heater 30. Accordingly, the nodes N1 and N2 are maintained at the same voltage level, so that the photocoupler PC is maintained in an OFF state. As a result, a DC voltage (for example, a high signal) approximate to the reference voltage Vref is continuously applied to the microcomputer 90, as shown in FIG. 8.

Thus, the microcomputer 90 can calculate the time, for which the power supply to the heater 30 is cut off in accordance with the OFF state of the first and second thermostats TS1 and TS2, based on the waveform of the DC voltage applied to the microcomputer 90.

FIG. 9 depicts waveforms of detect signals recognized by the microcomputer. In FIG. 9, "R" represents the diameter of the external exhaust duct 50, and the unit of the diameter R is in inches. The waveforms of FIG. 9 represent detect signals generated from the detecting circuit 80, as shown in FIG. 7 or 8, and recognized by the microcomputer as power supply/cutoff state information, namely, ON/OFF information, for diameters of R(2.0), R(2.3), R(2.625), R(2.88), and R(3.0), respectively. Referring to FIG. 9, it can be seen that the air flow interference (clogging degree) in the air passage is lower at a larger diameter, and is higher at a smaller diameter.

In order to determine the clogging degree of the air passage, a determination method using a power supply ON/OFF duty ratio is used in accordance with the present invention. In the illustrated embodiment, one or either of an ON duty ratio (x'/y') or an OFF duty ratio (z'/y') may be used. The following description will be given in conjunction with the OFF duty ratio (z'/y').

The OFF duty ratio of the case "R(2.0)" is 0.48 (ON duty ratio is 0.52), the OFF duty ratio of the case "R(2.3)" is 0.32 (ON duty ratio is 0.68), the OFF duty ratio of the case "R(2.625)" is 0.26 (ON duty ratio is 0.74), the OFF duty ratio of the case "R(2.88)" is 0.13 (ON duty ratio is 0.87), and the OFF duty ratio of the case "R(3.0)" is 0 (ON duty ratio is 1). That is, it can be seen that the OFF duty ratio increases as the diameter decreases. On the other hand, the ON duty ratio decreases. Thus, the microcomputer 90 can determine the clogging degree of the air passage (in particular, the clogging degree of the lint filter 41 or external exhaust duct 50) by calculating the OFF duty ratio. Results of an experiment measuring the clogging degree of the air passage are described in the following Table 1.

TABLE 1

| OFF Duty Ratio | Clogging Degree | Clogging Position |
|---|---|---|
| 0 to 0.30 | — | — |
| 0.30 to 0.45 | Low (Slight) | Lint filter |
| 0.45 to 0.60 | Medium (Medium) | Lint filter (severely clogged)/Exhaust duct (medially clogged) |
| 0.60 or more | High (Severe) | Exhaust Duct |

The microcomputer 90 stores air passage clogging information acquired based on the above-described ON/OFF duty ratio. The storing operation is repeatedly carried out in accordance with the number of drying operations carried out in the cabinet 1. In particular, when the cabinet 1 is initially installed, or is re-installed due to house-moving or other reasons, the microcomputer 90 initially stores an initial clogging degree of the air passage, more accurately, an initial clogging degree of the exhaust duct 50, and additionally stores a clogging degree according to a subsequent drying operation whenever the drying operation is carried out. For example, the microcomputer 90 stores a value D0 as an initial clogging degree, and values D1, D2, . . . , Dn−1, and Dn as subsequent clogging degrees.

Although the present invention has been described in conjunction with the above-described embodiments and the accompanying drawings, it is not limited to such embodiments and drawings.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

A control apparatus for a dryer described in claim 1 as filed comprises: a power supply circuit comprising a heating coil arranged in a heater case, and at least one temperature control member mounted to the heater case, the temperature control member receiving power, and supplying the received power to the heating coil; a microcomputer for controlling an operation of the dryer; and a connecting line for connecting the power supply circuit to the microcomputer.

In the control apparatus described in claim 2 as filed, the temperature control member is mounted to an outer surface of the heater case.

The control apparatus described in claim 3 as filed further comprises a detecting circuit connected to the connecting line, to detect an ON/OFF state of the temperature control member.

In the control apparatus described in claim 4 as filed, the connecting line is connected to an electric wire between the temperature control member and the heating coil.

In the control apparatus described in claim 5 as filed, the temperature control member comprises an input terminal connected to a power source, a first output terminal connected to the heating coil, and a second output terminal connected to the connecting line.

In the control apparatus described in claim 6 as filed, the first and second output terminals has at least portions connected to each other, respectively.

In the control apparatus described in claim 7 as filed, the first and second output terminals are integrated with each other.

In the control apparatus described in claim 8 as filed, the at least one temperature control member comprises a non-return type temperature control member, which is transited from an ON state to an OFF state in a non-returning manner in accordance with ambient temperature, and a return type temperature control member, which is transited between an ON state and an OFF state in a returnable manner in accordance with ambient temperature.

In the control apparatus described in claim 9 as filed, the connecting line is connected to an output terminal of the non-return type temperature control member, or to an output terminal of the return type temperature control member.

As apparent from the above description, the present invention provides an effect capable of providing a connection between a temperature control member and a microcomputer (or a detecting circuit), to determine the clogging degree of an air passage defined in a dryer.

The present invention also provides an effect capable of achieving an easy identification of input and output terminals in an operation to connect a temperature control member and a microcomputer (or a detecting circuit) in an assembly operation for a dryer.

What is claimed is:

1. A control apparatus for a dryer, comprising:

a power supply circuit comprising a heating coil arranged in a heater case, and at least one temperature control member mounted to the heater case, the at least one temperature control member receiving power, and supplying the received power to the heating coil;

a microcomputer that controls an operation of the dryer; and a connecting line that connects the power supply circuit to the microcomputer, wherein the at least one temperature control member comprises:

a non-return type temperature control member that transits from an ON state to an OFF state in a non-returning manner in accordance with ambient temperature; and a return type temperature control member that transits between an ON state and an OFF state in a returnable manner in accordance with ambient temperature.

2. The control apparatus according to claim 1, wherein the at least one temperature control member is mounted to an outer surface of the heater case.

3. The control apparatus according to claim 1, further comprising:

a detecting circuit connected to the connecting line, that detects an ON/OFF state of the at least one temperature control member.

4. The control apparatus according to claim 1, wherein the connecting line is connected to an electric wire between the at least one temperature control member and the heating coil.

5. The control apparatus according to claim 1, wherein the at least one temperature control member comprises an input terminal connected to a power source, a first output terminal connected to the heating coil, and a second output terminal connected to the connecting line.

6. The control apparatus according to claim 5, wherein the first and second output terminals have at least portions connected to each other, respectively.

7. The control apparatus according to claim 5, wherein the first and second output terminals are integrated with each other.

8. The control apparatus according to claim 1, wherein the connecting line is connected to an output terminal of the non-return type temperature control member, or to an output terminal of the return type temperature control member.

9. A dryer comprising the control apparatus of claim 1.

* * * * *